US006367380B1

(12) United States Patent
Whelan

(10) Patent No.: US 6,367,380 B1
(45) Date of Patent: Apr. 9, 2002

(54) INKING SYSTEM WITH A BELT AND DIFFERENTIAL ROLLER SPEEDS

(75) Inventor: Edward J. Whelan, Lakewood, NJ (US)

(73) Assignee: Sequa Can Machinery, Inc., East Rutherford, NJ (US)

( * ) Notice: Subject to any disclaimer, the term of this patent is extended or adjusted under 35 U.S.C. 154(b) by 0 days.

(21) Appl. No.: 09/327,831

(22) Filed: Jun. 8, 1999

Related U.S. Application Data

(63) Continuation-in-part of application No. 09/239,267, filed on Jan. 29, 1999, now abandoned.
(60) Provisional application No. 60/073,320, filed on Feb. 2, 1998.

(51) Int. Cl.[7] ..... B41F 31/00
(52) U.S. Cl. ..... 101/350.4; 101/DIG. 33
(58) Field of Search ..... 101/DIG. 33, 350.4, 101/202, 205, 339, 348, 349.1, 350.1; 474/164, 168, 170, 176, 238, 242

(56) References Cited

U.S. PATENT DOCUMENTS 1,840,009 A * 1/1932 Ball et al. ..... 101/DIG. 33
2,036,451 A * 4/1936 Wood ..... 101/DIG. 33
3,168,037 A * 2/1965 Dahlgren ..... 101/148
4,404,908 A 9/1983 Simeth
4,454,813 A 6/1984 Barrois et al.
4,708,059 A * 11/1987 Junghans ..... 101/350
4,993,321 A 2/1991 Dennstedt

* cited by examiner

*Primary Examiner*—Eugene Eickholt
(74) *Attorney, Agent, or Firm*—Mitchell D. Bittman; Lawrence A. Hoffman; Robert Faber

(57) ABSTRACT

To minimize the presence of roll-to-roll nips in an inking system for a printing plate cylinder, an ink transfer belt transfers ink from an ink transfer roller, which receives ink from a supply, to the ink receiving elements on a printing plate cylinder. A plurality of guide rolls inside the loop of the ink transfer belt contact the drivable surface of that belt. A drive is connected with one of the guide rollers for driving it to rotate at a first velocity, which is the velocity of the ink transfer roll and of the printing plate cylinder. An ink distribution roller is disposed outside the loop of the belt in contact with the opposite, ink transfer surface of the belt and between the ink transfer roller and the printing plate cylinder. The ink distribution roller is driven to rotate at a different speed than the ink transfer belt and is also driven to vibrate or to oscillate axially for ink distribution on the ink transfer surface of the belt. Various embodiments include different numbers of guide rollers in the loop of the belt, more than one ink distribution roller in engagement with the ink transfer surface of the belt and more than one belt in engagement with the periphery of the ink distribution roller.

58 Claims, 7 Drawing Sheets

FIG. 9.
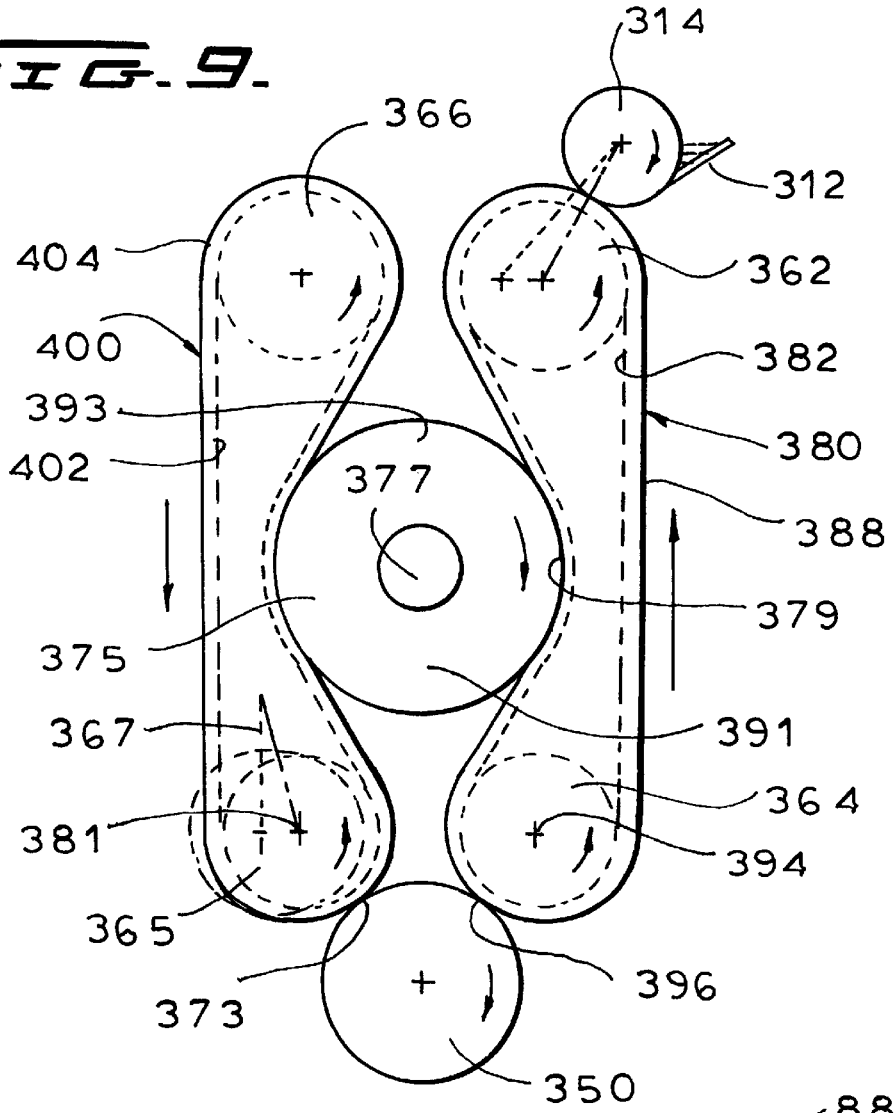
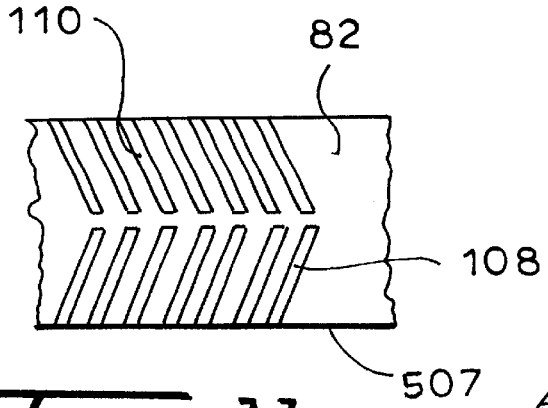
FIG. 11.
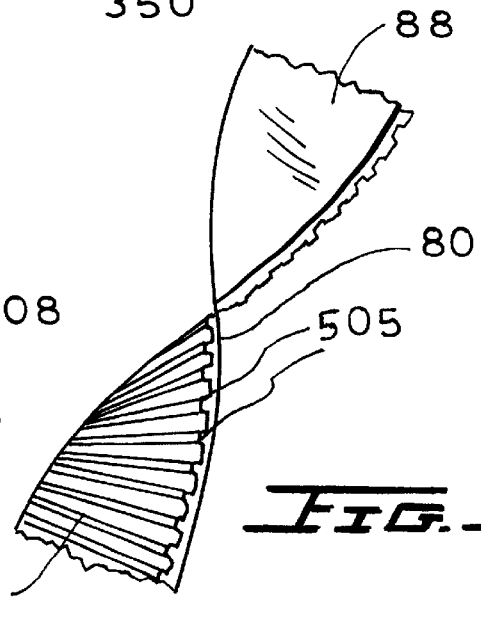
FIG. 10.

INKING SYSTEM WITH A BELT AND DIFFERENTIAL ROLLER SPEEDS

This application claims the benefit of U.S. Provisional Application 60/073,320 filed Feb. 2, 1998.

CROSS REFERENCE TO RELATED APPLICATION

This is a Continuation-In-Part of application Ser. No. 09/239,267, filed Jan. 29, 1999, now abandoned.

BACKGROUND OF THE INVENTION

The present invention relates to ink printing, particularly to printing of cans, and particularly relates to an inking system for the printing apparatus. In the printing industry, productivity advancement is important. Most productivity advances have come through increased operating speed. Inking arrangements have used the fundamental roller to roller method virtually since modern inking systems were devised. Physics and practicality limit the size and numbers of rollers in such a system.

In a typical roller to roller inking system, ink is supplied to a first roller, e.g. a ductor roller, and from there the ink is transferred to other rollers in succession at nips between adjacent rollers. The ink application roller or form roller or form rollers preceding the printing plate cylinder in the series should be covered with rubber or a rubber-like material. The printing plate is on a cylinder that forms a nip with the form roller or forming rollers and the ink receiving elements on the surface of the printing plate cylinder are formed of metal or a metal-like material. The printing plate cylinder, in turn, transfer ink to a printing "blanket" which then prints on an article, e.g. a can.

Inking systems typically use rubber covered or rubber-like material covered rollers alternating with steel or other metal-like hard covered rollers in a series of rollers leading to the printing plate cylinder. When the rubber-like rollers contact the metal-like rollers at nips, the surfaces of the rubber-like rollers deflect and displace at the contact nips for reducing the probability of roller surface damage and controlling ink thickness on the rollers. As the rubber or rubber-like material rotates out of the nip, it deflects again to restore its original shape. Rubber or rubber-like material covered rollers are adjustable during system operation to be set at appropriate contact pressures against the adjacent metal rollers. Since each rubber roller is typically between adjacent metal rollers, this may require a time-consuming compound adjustment of several rollers. A rubber roller or rubber-like surface on a roller which is in pressure contact with the adjacent metal rollers, experiences friction from the texture of the adjacent metal rollers. Over time, a rubber, or rubber-like roller surface tends to wear so that the roller or its surface must be replaced frequently, and the wearing requires frequent roller position adjustment as the roller diameter changes through wear. As existing inking systems are complex with multiple parts, there are related high manufacturing and maintenance and adjustment costs.

The ink from an ink supply tends to adhere to each roller surface after the ink contacts the roller and after a nip has been passed, which causes the ink to be eventually transmitted to the printing plate cylinder.

Although ink tends to adhere to a roller surface after contact, the modulus of elasticity of the ink is eventually exceeded after each nip, due to the speed of roller rotation, the deflection of the roller surface and separation of the roller surfaces after they pass through a contact nip. The contact of adjacent rollers at a nip when the rollers are rotating rapidly rollers separate after the inked surfaces rotate out of the nip. The ink is in tension during the separation and splits when its tension limit is exceeded. The splitting causes the ink to form mist, and to also form airborne particles which are slung and may be dropped to adjacent rollers and may texture a roller surface at which the ink splitting occurs. This may contaminate and/or produce a textured ink surface on roller surfaces and may contaminate adjacent areas of the inking system. In addition, the mist contaminates the air and surrounding equipment. This situation is aggravated at higher operating speeds due to increasing centrifugal force at the roller surfaces, which is likely to sling more of the ink and create more mist. The ink is both slung and split at each roller surface separation following a nip. If the atomized ink is not controlled, it spreads around the inking system and its parts and can become a health hazard. It is not uncommon for an inking system to have nine or even more positions at which an ink split occurs. Further, a typical can printer apparatus may have several separate inking systems operating simultaneously to apply ink from their printing plate cylinders to a printing blanket. This multiplies the ink split problem.

Many printing presses have overhead shrouds or chambers with induced suction with the intent of capturing ink particles. It is not practical to attempt to recycle the recaptured ink because it is a mixture of various pigments and chemistry, and the waste ink must be disposed of ecologically safely, which is a costly process. Reducing the amount of waste ink to be collected is desirable.

Most inking systems use two or more rubber covered form rollers to transfer ink from the preceding distributing rollers to the printing plate cylinder surface. Form rollers typically have relatively small diameters due to space limitations that are inherent in inking system designs. Form rollers must receive compound adjustments so that they can contact both the ink distributing rollers and the printing plate cylinder at the same time. Because of their relative sizes as compared to the printing plate cylinder, the form rollers often make more than one revolution for each revolution of the printing plate cylinder, which leads to the "ghosting" or "halo", printing effect discussed below.

The printing plate at the end of an inking system is normally wrapped on a printing plate cylinder or roller. The printing plate is in many cases a relief plate, with raised surface areas that accept ink from the form rollers and with recessed areas to which ink is not to be transferred. The raised areas of the printing plate eventually indent the form rollers with the printing plate image. Those indented areas on the form roller make it difficult for the ink distribution roller to apply ink uniformly and evenly to the printing plate via the form rollers. The uneven distribution of ink on the printed substrate causes a "ghosting" or "halo" effect. Ghosting occurs when two similar images are offset from each other. One solution is to provide multiple form rollers of different diameters to help reduce the ghosting. This adds to material, manufacture and complexity of operation costs and increase maintenance.

Each time a different matter or different color is printed, it is necessary to change the printing plates and/or the ink colors used in the inking system. During changing of ink colors, the ink distributing rollers must be cleaned to avoid contamination of the new color by the previous color. Semi-automatic cleaning systems for the rollers do not assure complete cleaning, so that some hand cleaning is required. It is time consuming and can be dangerous to the operator. Belt type inking systems reduce the number of rollers that must be cleaned.

The foregoing describes problems experienced with conventional roller to roller inking systems.

But, inking systems using belts entrained over rollers for ink transfer and distribution are known in the art. One example is disclosed in U.S. Pat. No. 2,036,451, which shows a belt for ink transfer entrained around guide rollers within the loop of the belt and also provided with an ink distribution roller partially wrapped around by the external ink carrying surface of the belt and located along the belt path between two nips formed with the printing plate cylinder. Although the benefit of ink distribution for eradicating a pattern left during previous contact with the plates is disclosed in this prior art patent, operation of the ink distribution roller as disclosed below is not suggested.

Multiple belt type inking systems used in a single printing apparatus are disclosed in U.S. Pat. Nos. 536,077; 773,444; 1,691,795; 3,366,056; 4,593,617. Other belt type ink distribution arrangements are found in U.S. Pat. Nos. 2,622,522 and 4,993,321. In none of these references is the ink distribution roller driven or moved as disclosed below.

SUMMARY OF INVENTION

Accordingly, one object of the invention is to minimize ink splitting and at least substantially reduce ink slinging off the rollers, and/or mist creation.

Another object of the invention is to improve the ink transfer onto the printing plate cylinder, which is required for high-quality printing.

Another object is to eliminate or substantially reduce "ghosting" or "halo" printing.

The present invention includes an endless loop belt having one ink receiving, ink carrying and ink transferring surface outside the belt loop and an opposite drive surface inside the belt loop. The belt is entrained over a plurality of guide rollers which engage the drive surface of the belt and guide the belt. At least one ink distribution roller engages the ink carrying surface of the belt after ink has been supplied to that surface and before the contact of that surface with the printing plate cylinder for distributing the ink over the ink carrying surface.

The ink carrying belt, the guide and drive rollers for the belt and the printing plate cylinder all travel at the same surface velocity in one direction.

The ink distribution roller is a smooth surface roller to enhance the ink distribution and make it more uniform, and to avoid ghosting and halo printing. In one preferred version, the ink distribution roller travels in the one direction at a surface velocity that is different than, i.e., either faster or slower than, the surface velocity of the ink carrying surface of the belt which passes over the ink distribution roller. In particular, the ink distribution roller is recommended to travel at a surface velocity that is in the range of 2% to 40% faster or slower than the velocity of the ink carrying belt. This tends to distribute the ink uniformly and at the correct thickness over the ink carrying surface of the belt.

Further, the ink carrying roller is vibrated or oscillated axially while revolving around its fixedly located rotation axis. This also assures proper ink distribution and eliminates the halo effect on the belt caused by the continued contact of the printing plate cylinder with the ink carrying surface of the belt.

To control the speed at which the ink carrying belt is driven, at least one of the guide rollers for the ink carrying belt is driven, although more than one of those rollers may be driven. The roller(s) is driven by a power source, preferably mechanically coupled to the main drive of the decorator. Each of the guide rollers is toothed around its periphery complementary to toothing of the drive surface of the belt. The toothing may also be profiled to prevent the belt from shifting laterally or axially, particularly under the influence of the axial vibration of the ink distribution roller.

The benefits of the invention include possible avoidance of use of rubber covered rollers and elimination of the repeated replacement and adjustments required when such material rollers are used; reducing ink splitting by a significant amount; reducing the number of nips or locations where the ink is spread and squeezed and opening of nips which would lead to splitting and slinging of ink; reducing ghosting or halo images; reducing the amount of maintenance and cleaning that are normally required; and reducing manufacturing costs.

With the present invention, when the ink is changed, only the ink distribution roller requires cleaning along with any other rollers which are outside the belt loop. But, the rollers inside the belt loop do not require cleaning, reducing the clean up required between ink color changes.

The clean up of the system of the invention is simple in that the ink transfer belt is removed, the ink distribution roller is cleaned and a new belt is installed. The removed belt can be cleaned apart from the operation of the inking system and a new belt can be immediately installed, minimizing the down time of operation while a belt is off the machine.

Although it is not intended to restrict the applications for the inking system of the invention, it is designed for use in continuous can printing and handling apparatus which applies decoration to the exteriors of cylindrical containers or cans while the containers are mounted on respective mandrels disposed along the periphery of a large, rotating, wheel-like carrier. An example of such an application is found in U.S. Pat. No. 5,111,742, to the assignee hereof. Several separate inking systems, each a system according to the invention, are arrayed around a large diameter printing blanket cylinder, and the blanket is inked by the printing plate cylinder of each of the inking systems. The blanket then transfers the ink to successive containers or cans to be decorated which are presented to the blanket by the individual mandrels, as the blanket and the array of mandrels rotate or move past one another. For application of the inking system of the invention to a can printer, U.S. Pat. No. 5,111,742 is incorporated by reference. Because several inking systems are used, for example, in one embodiment, perhaps as many as eight or nine inking systems, at the printing blanket, the danger of the ink splitting and contamination described above is multiplied and any arrangement to reduce that is desired. Each inking system is in effect an individual machine installed on a can handling system. The inking system is an intricate and delicate device with numerous wearable parts, like bearings, rubber rollers, adjusting mechanisms, and ink contamination is a major source of wear and maintenance problems.

Other objects and features of the present invention will become apparent from the following description of the accompanying drawings.

BRIEF DESCRIPTION OF THE DRAWINGS

FIG. 9 is a schematic side view of a fourth embodiment thereof;

FIG. 10 illustrates one version of the drive of the belt of the invention; and FIG. 11 illustrates another version of the drive belt which may be used with the invention.

DESCRIPTION OF THE PRIOR ART

Figure 1:
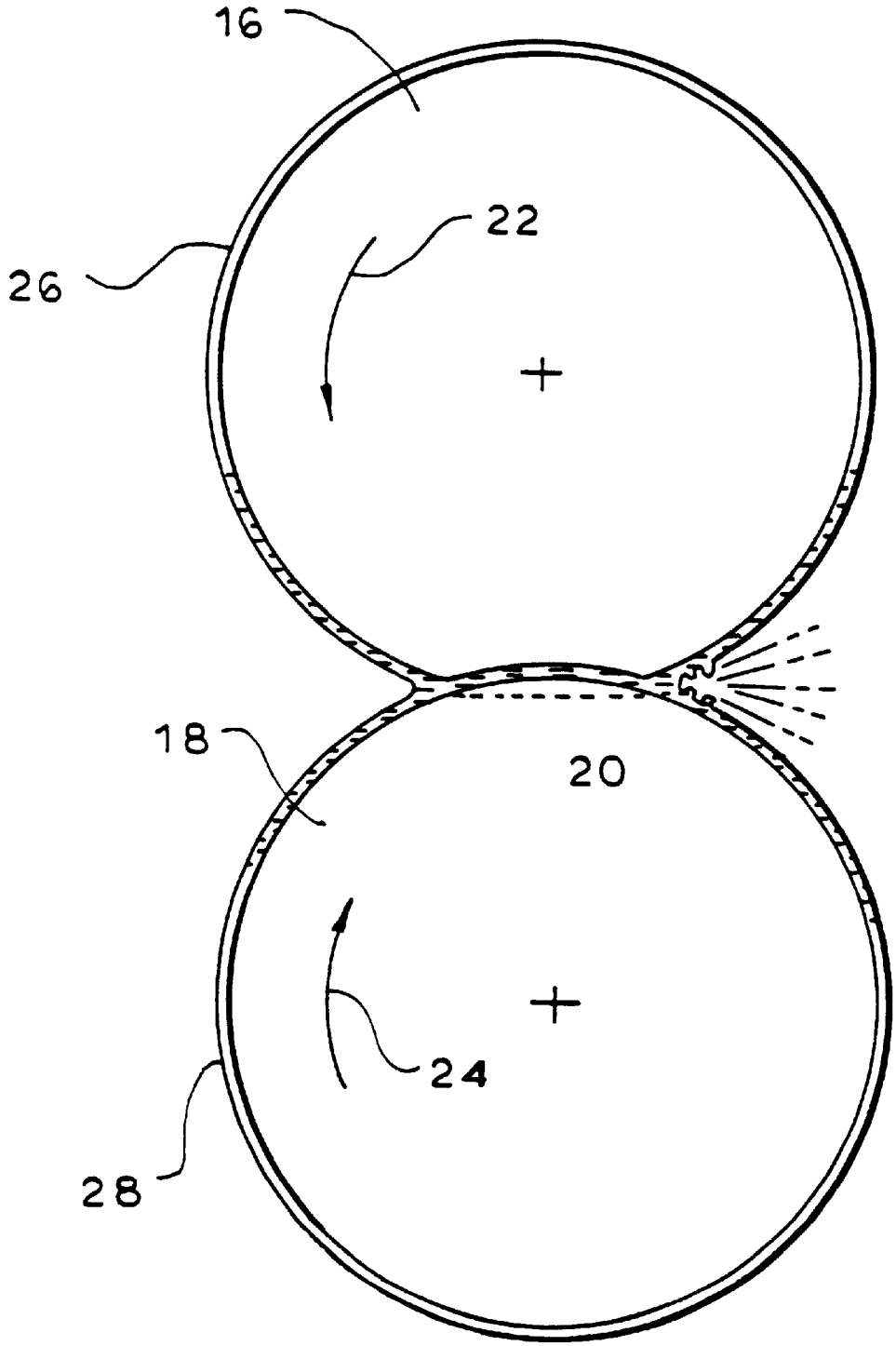
FIG. 1. PRIOR ART
FIG. 1 is a descriptive view showing ink separation or splitting and slinging in a conventional roller to roller transfer of ink.

The prior art system shown in FIG. 3, which is described further below, uses a series of rollers which transfer ink ultimately to a printing plate cylinder. In FIG. 1, two successive inking system rollers 16 and 18, e.g. in a system shown in FIG. 3, meet at a nip 20. Their respective directions of rotation are illustrated by arrows 22 and 24 at the same surface velocity. Ink from the peripheral surface 26 of the roller 16 transfers to the peripheral surface 28 of the roller 18 at the nip 20. As the roller surfaces 26, 28 pass through the nip 20 the rubber roller surface 26 is displaced by the steel roller and the ink on that surface displaces too. As the surfaces rotate out of the nip 20, the rubber surface springs back to its original form and ink which has been squeezed against both roller surfaces in the nip 20, is released from that pressure. If the rollers 16 and 18 are rotating fast enough, as they do in current high speed printing, the liquid ink on the surfaces 26 and 28 is slung or flung off the surface in droplets. In addition, when the rollers separate just past the nip, the ink is "split" to form droplets of mist, creating a mist around the entire apparatus, which undesirably coats the rollers, adjacent machinery, the printing surface, etc. One sees slinging and mist formation in FIG. 1 over a significant angular surface section, off both roller surfaces 26 and 28 of the roller 16 and 18.

Figure 2:
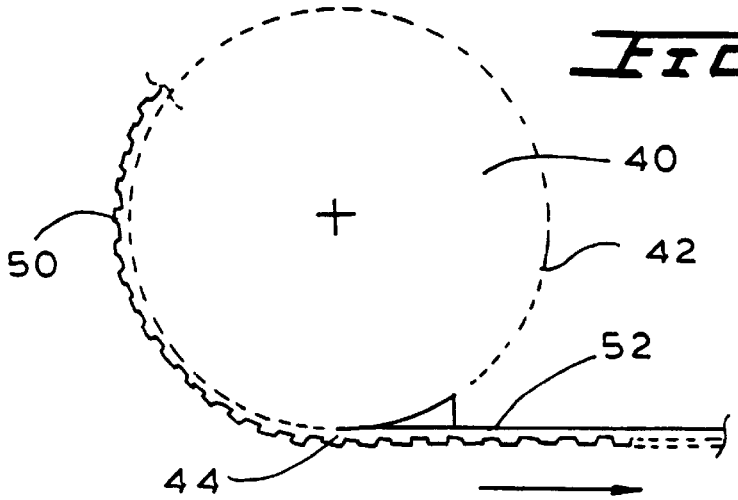
FIG. 2 is a descriptive view showing the ink separation occurring in a roller to belt transfer, which occurs in the invention.

One sees the difference provided by the invention, as illustrated in FIG. 2, where the ink carrying surface 52 of the ink transfer belt 50 separates from the peripheral surface 42 of the roller 40 following the separation nip 44. Ink will at most be flung off and form mist in a narrower height pocket defined between the ink carrying surface 52 of the belt 50 and the peripheral surface 42 of the roll, causing less slinging of ink and less misting of ink for the same roller surface velocity, as compared with FIG. 1. Over the same time period and amount of rotation of a roller, where two rollers are separating, as in FIG. 1, the rate of separation of the previously nipped surfaces is perhaps twice as great as the rate of separation where a belt is separating from the roller, as in FIG. 2, and a roller to roller separation increases ink splitting. Further, as discussed herein, in a preferred embodiment the belt 50 and the peripheral surface 42 of the roller 40 are moving at usually slightly differing speeds. Hence, when the belt and roller surface separate, they do so with shearing of the ink and some splitting. But less splitting and less slinging of ink are expected with resultant benefits.

Other features of the system of the invention are described below.

Figure 3:
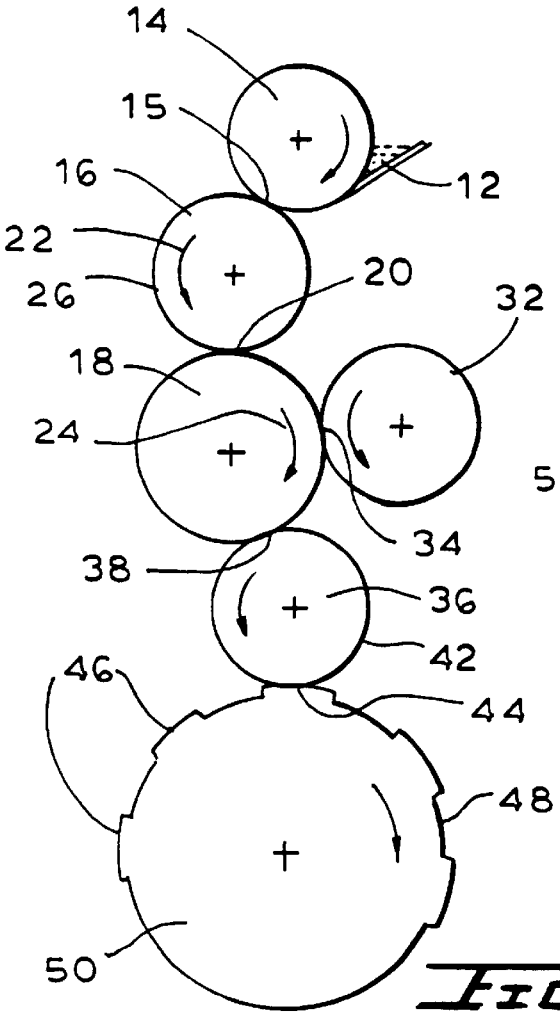
FIG. 3. PRIOR ART
FIG. 3 is a schematic side view of a prior art roller to roller inking system.

FIG. 3 illustrates a typical prior art roller to roller inking system for a printing plate cylinder. An ink fountain or reservoir or other conventional ink supply 12 is placed adjacent the surface of a first ink receiving fountain roller 14, which rotates clockwise in FIG. 3. The ink supply reservoir 12 provides a coating of ink to the surface of the roller 14 as it rotates past. The roller 14 forms a first nip 15 with a ductor roller 16. Ductor rollers are typically movable slightly away from or toward the fountain which regulates the amount of the inking of the ductor roller and therefore of the following rollers. The ink travels on the periphery 26 of the roller 16 through a second nip 20 onto the periphery of the next ink transfer roller 18. There may be a smoothing or distributing roller 32 which forms another nip 34 with the roller 18 and smooths the ink on the roller 18. Actually, there may be several smoothing or distributing rollers respectively forming nips with several of the rollers at the series of rollers transferring the ink. Several more ink transfer rollers may be provided in the series. An ink application roller 36 or form roller meets the last ink transfer roller 18 at a third nip 38 between them. The periphery 42 of the form roller 36 picks up ink from the transfer roller 18 to be delivered to the peripheral surface of the printing plate cylinder 50. The ink application roller 36 has a rubber like surface while the transfer roller 18 has a hard metal surface. The ductor roller 16 again has a rubber like surface while the fountain roller 14 has a hard metal surface.

The ink application or form roller 36 forms a fourth nip 44 with the ink receiving print types 46 which are slightly upraised on the metal-like peripheral surface 48 of the printing plate cylinder 50. Thus, ink from the ink supply reservoir 12 passes over the series of rollers, through nips 15, 20, 34, 38 and 44 before being transferred to the printing plate cylinder 50. From there, ink is applied at 54 by the types 46, to the surface 56 of the printing blanket 58 which brings the ink image to the items being ink printed. As FIG. 1 illustrates, the numerous nips combined with the rotation velocity of the rollers will cause considerable ink slinging and mist formation, which is undesirable.

Figure 4:
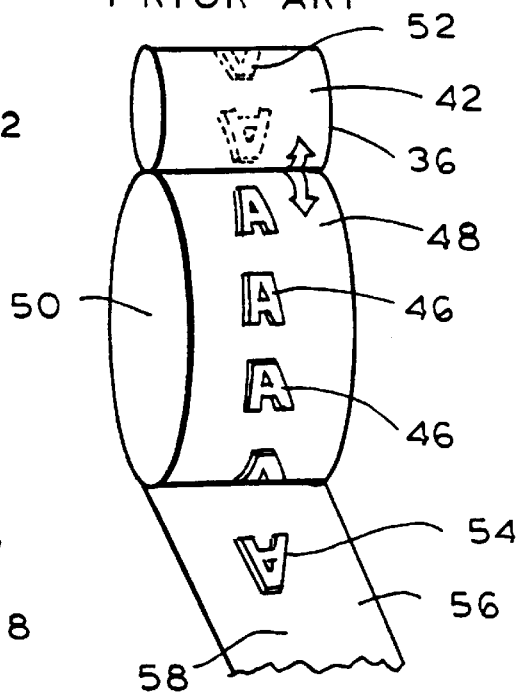
FIG. 4. PRIOR ART
FIG. 4 is a view of the forming roller and the printing plate cylinder of the system of FIG. 3 illustrating the residual ghost or halo image problem.

Further, as shown in FIG. 4, as the types 46 repetitively rotate over the peripheral surface 42 of the smaller diameter ink application roller 36, residual ghost like images 52 are left in the surface 42, and more particularly on the ink on the surface 42 of the ink application or form roller 36, and the images 52 may be transferred to the printing plate cylinder 50.

The present invention is designed to avoid the above problems experienced with the prior art of FIGS. 1, 3 and 4.

DESCRIPTION OF THE PREFERRED EMBODIMENTS

Several representative embodiments of the invention are disclosed. Each has an ink carrying belt which is driven at and guided on its drive surface by a plurality of drive and guide rollers. The belt has an opposite ink carrying surface on which ink is received, and that surface is exposed to at least one ink distribution roller which distributes the ink over the ink carrying surface. That surface of the belt then transfers the ink to the printing plate cylinder. The embodiments of the invention therefore can be easily retrofitted into an existing printing apparatus, and the belt and roller configuration would be arranged and shaped and oriented as to be fitted into the printing apparatus. The particular configuration and placement of the various rollers is a matter of choice for ease in installation in an existing apparatus, for example.

Figure 5:
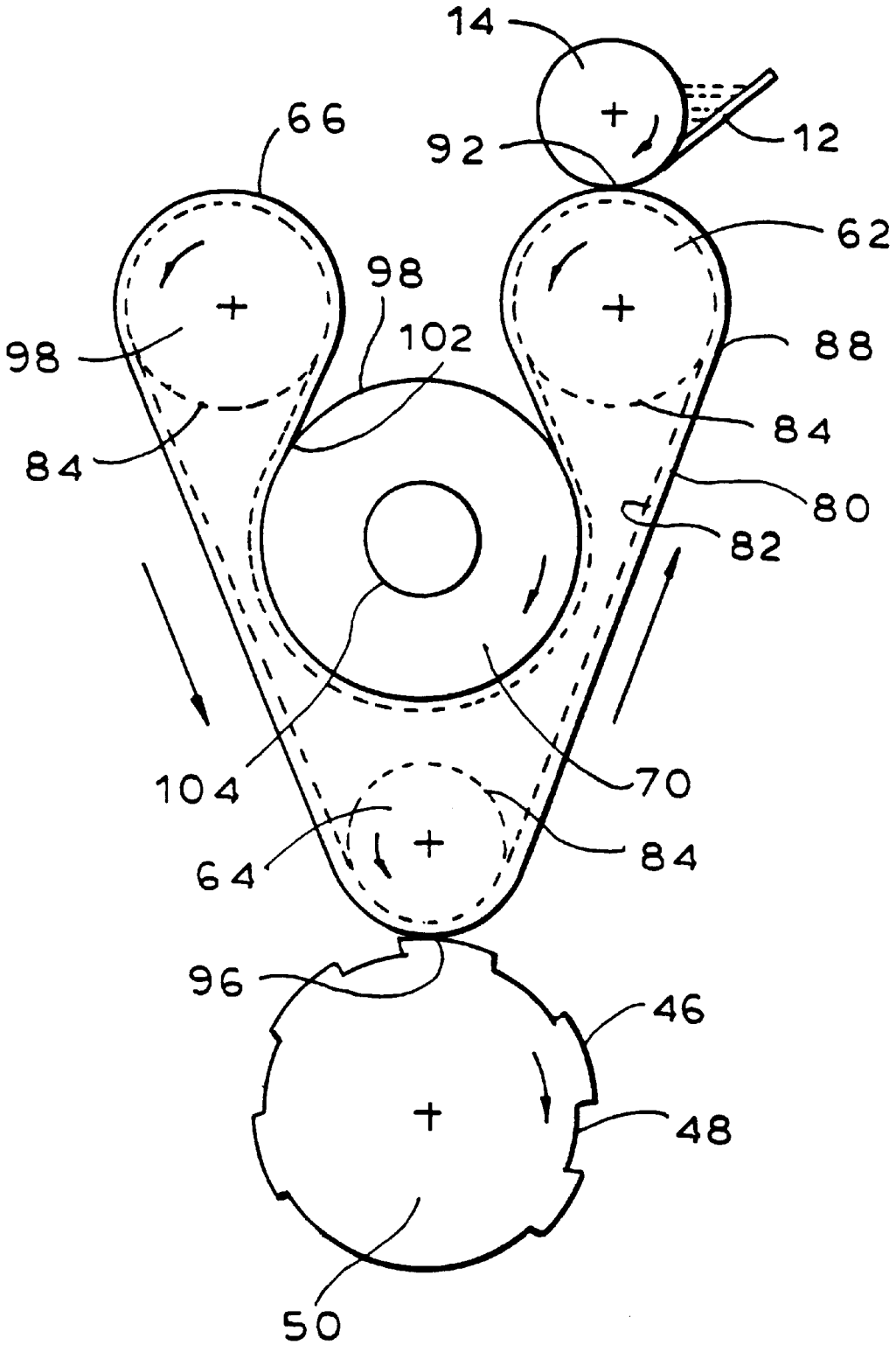
FIG. 5 is a schematic side view of a first embodiment of an inking system with differential velocities according to the present invention.
Figure 6:
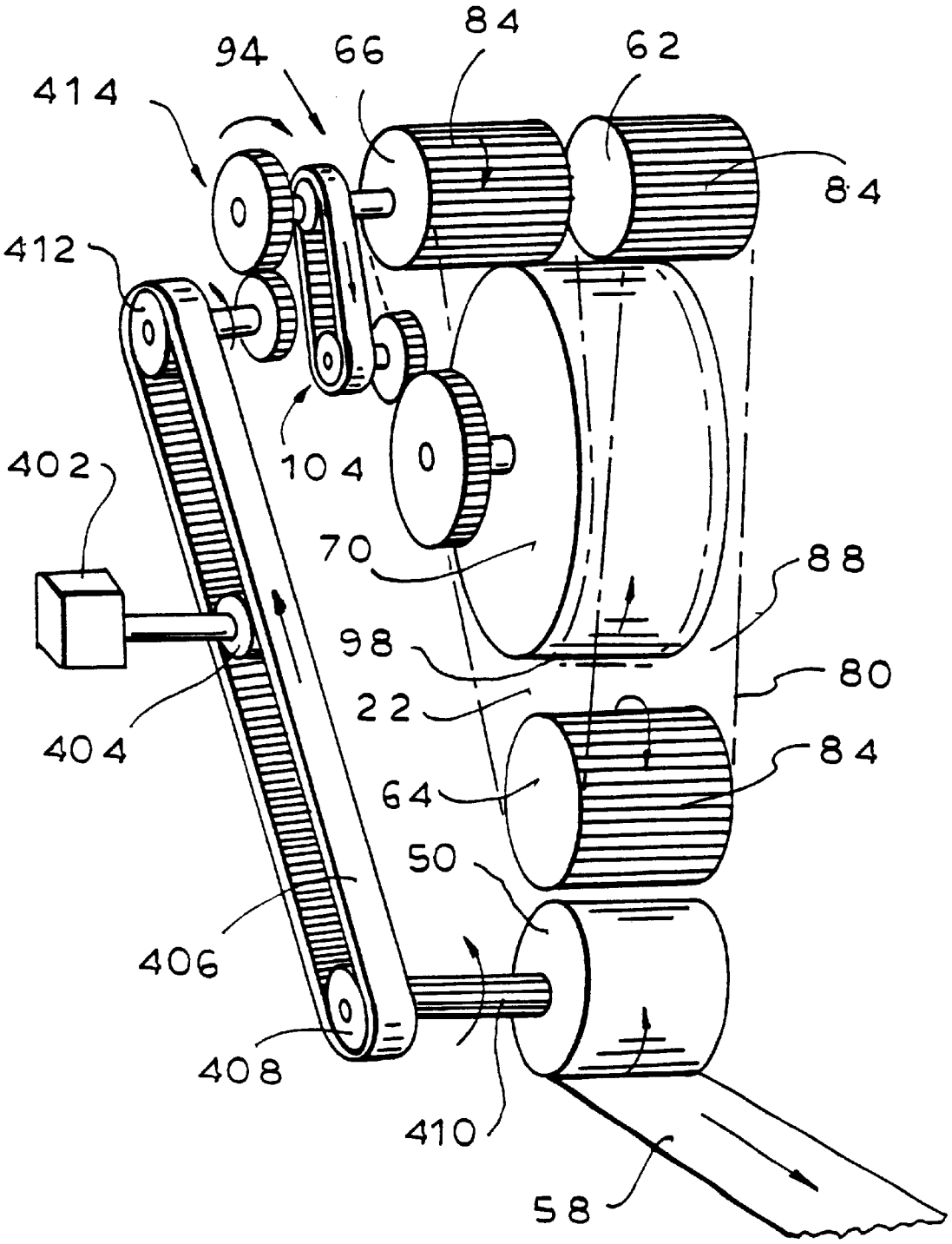
FIG. 6 is a perspective view of the embodiment of FIG. 5, showing the drive elements.

In the embodiment of FIGS. 5 and 6, conventional ink supply or fountain 12 and ink receiving or fountain roller 14 are present, as is the printing plate cylinder 50 with ink receiving types 46 upraised from its surface 48.

A plurality, here illustrated as three, of ink carrying belt guide rollers 62, 64 and 66 are fixedly supported for rotation around their respective center axes. The roller positions are selected for achieving results to be described.

An ink distribution roller 70 of different design is also fixedly supported for rotation about its center axis.

An endless loop ink carrying and transfer belt 80 is entrained over the four rollers 62, 64, 66 and 70. The belt has an inwardly facing drive surface 82 which drivingly engages the exterior peripheral surfaces of all of the guide rollers 62, 64 and 66, which are inside the belt loop. Those exterior peripheral roller surfaces are described further below. To assure driving engagement of the belt with all three rollers, to avoid slippage and provide a correct drive speed, the drive surface 82 of the belt 80 and the exterior peripheral surfaces 84 of all of the drive and guide rollers 62, 64 and 66 are complementary cooperatingly toothed, as described below in connection with FIGS. 10 and 11, so that all of the drive rollers and the belt have the same surface velocity and also so that the belt is held non-shifting in the axial direction along the axis of any of the rollers. The belt 80 may be a "timing" belt with its inward drive surface 82 as a molded, reinforced, endless timing or gear belt and having neoprene or other appropriate rubber-like material applied to the outer surface 88 of the timing belt to define the ink carrying surface of the belt.

FIG. 10 illustrates a fragment of a preferred embodiment of the belt 80 which has the smooth neoprene rubber ink carrying outward surface 88 and the inward drive surface 82. The drive surface 82 is illustrated in FIG. 10 as having one row of teeth 505 which extend straight in the direction across the belt, not obliquely. This might achieve reduced noise, for example. Since the belt structure does not prevent its lateral shifting with respect to the rollers, an appropriate edge dam on the roller(s) or other obstruction to lateral belt motion is needed. Other arrangements for preventing the belt from moving laterally should be apparent to one of skill in the art.

In FIG. 11, in contrast, the belt 507 has two rows of teeth 108, 110, which are reversely obliquely inclined. The peripheral surfaces 84 of the all of the rolls 62, 64 and 66 are complementary and cooperatingly toothed to mesh with the teeth rows 108, 110 of the belt. This assures precise speed drive of the belt to be coordinated with rotation of the printing plate cylinder and with below described rotation of the ink distribution roller. The inclined teeth rows 108, 110 provide one technique for preventing the belt from shifting laterally or in the axial direction as the ink distribution roll 70 vibrates or is oscillated.

The first ink guide roller 62 is fixed in position to press the outer ink receiving and carrying surface 88 of the belt 80 to form a nip 92 with the peripheral surface of the ink transfer fountain roller 14. However, the roller 62 is also a ductor roller, shiftable to move the belt off the fountain roller to thereby regulate application of ink to the belt surface 88. Similarly, the position of the guide roller or form roller 64 is fixed since it presses the ink carrying surface 88 of the belt 80 to the printing plate cylinder 50. At least one of the guide rollers 62, 64, 66, and preferably the roll 66, is a driven roll, driven by the drive 94 to rotate about its axis. It drives the belt 80, 82 to move, and the belt in turn drives the other rollers 64 and 66 to rotate. For convenience, to prevent slippage and/or as necessary, others of the rollers 64 and 66 may also be provided with a respective drive. Those drives are coordinated, e.g. as discussed below with reference to FIG. 6, so that all the rollers 62, 64 and 66 have the same surface velocity, regardless of their diameters. Further, at least the ink application roller 64 should be hard enough to press the rubber-like peripheral surface 88 of the belt, in the nip 96, with the types 46 on the periphery 48 of the printing plate cylinder 50.

The position of the roller 66 need not be fixed for engaging the belt with any other roller. Thus, the position of the roller 66 can be adjusted for maintaining desired tension on the belt 80.

In contrast to the drive and guide rollers 62, 64 and 66, the ink distribution roller 70 preferably has a hard peripheral surface 98 but, more important, a smooth surface for several reasons. The drive and guide rollers 62, 64 and 66 are all within the loop of the belt 80, while the ink distribution roller 70 is outside that loop and rubs against the exterior ink carrying surface 88 of the belt. After the belt surface 88 leaves the nip 92, it passes around the peripheral surface 98 of the ink distribution roller and separates from the roller 70 at the separating nip 102 just before passing around the guide roller 66. In FIG. 5, there is effectively a first roll to roll nip 92 and a second roll to roll nip 96, and there is a separating nip 102 between belt and roll, of the type described above in connection with FIG. 2. This is contrasted with the prior art arrangement of FIG. 3 where there are five roll to roll nips where ink split may occur, with above described disadvantages.

In FIG. 5, the image area on the printing plate cylinder, that is the types 46, do not again contact the ink carrying surface 88 of the belt 80 until the belt has made a complete cycle and returns to the printing plate with fresh, recently distributed ink, which has been distributed by the ink distribution roller 70. This significantly reduces the ghost or halo printing effect, which is seen in FIGS. 3 and 4, where the ink application or forming roller 36, 42 has a very short cycle before it again contacts the image areas 46 on the printing plate roller.

In order to aid in ink distribution over the peripheral surface 98 of the roller 70, the roller 70 is independently driven by drive 104 which drives the ink distribution roller 70 in the same direction as and at a different speed than the speed of the belt 80, either faster or slower than the belt with a speed difference in the range of 2% to 40% slower, so that the smooth peripheral surface 98 of the ink distribution roller rubs the outer ink carrying surface 88 of the belt 80 and the ink thereon, smoothing and distributing the ink on the belt over the continuous wrap region of the belt on the distribution roll, which is illustrated as about 270° at least. The greater is the wrap region, the better is the ink distribution.

To further enhance ink distribution and further reduce the possibility of ghosting or halo printing, the drive 104 for the ink distribution roller 70 causes that roller to vibrate axially, and in view of the rotation of the belt over the roller, to oscillate with respect to the belt, which enhances the complete ink distribution and erases any possibly remaining ghosting or halo printing. The rate of oscillation or vibration is a matter of choice, dependent upon the speed of the belt. It should be sufficient so that the belt surface 88 is exposed to several cycles of oscillations during its travel wrapped on the surface 98 of the roller 70. To take account of the axial vibration of the ink distribution roll, its axial length is greater than the width of the belt, so that the belt remains supported even as the ink distribution roller vibrates.

A suggested drive arrangement for the embodiment in FIG. 5 is shown in FIG. 6, where the same elements have the same numbers.

A drive motor 402 drives a toothed drive roller 404 which drives a timing belt 406 to rotate. That belt drives the printing plate cylinder 50 at gear 408 and shaft 410. The belt 406 drives the gear 412, which through gear train 414 drives the drive roller 66 and also drives the distribution roller 70. The diameters of the gears in the gear train 414 are coordinated with the diameters of the various rollers so that the plate cylinder 50 and the drive rollers 62, 64, 66 all have the same peripheral speed while the distribution roller 70 has a slower peripheral speed. The gears and belt drive in the gear train allow some shifting in the position of the axis of the drive roller 66 and/or of the distribution roller 70 to maintain tension in the ink transfer belt 80.

Other embodiments are now described.

Figure 7:
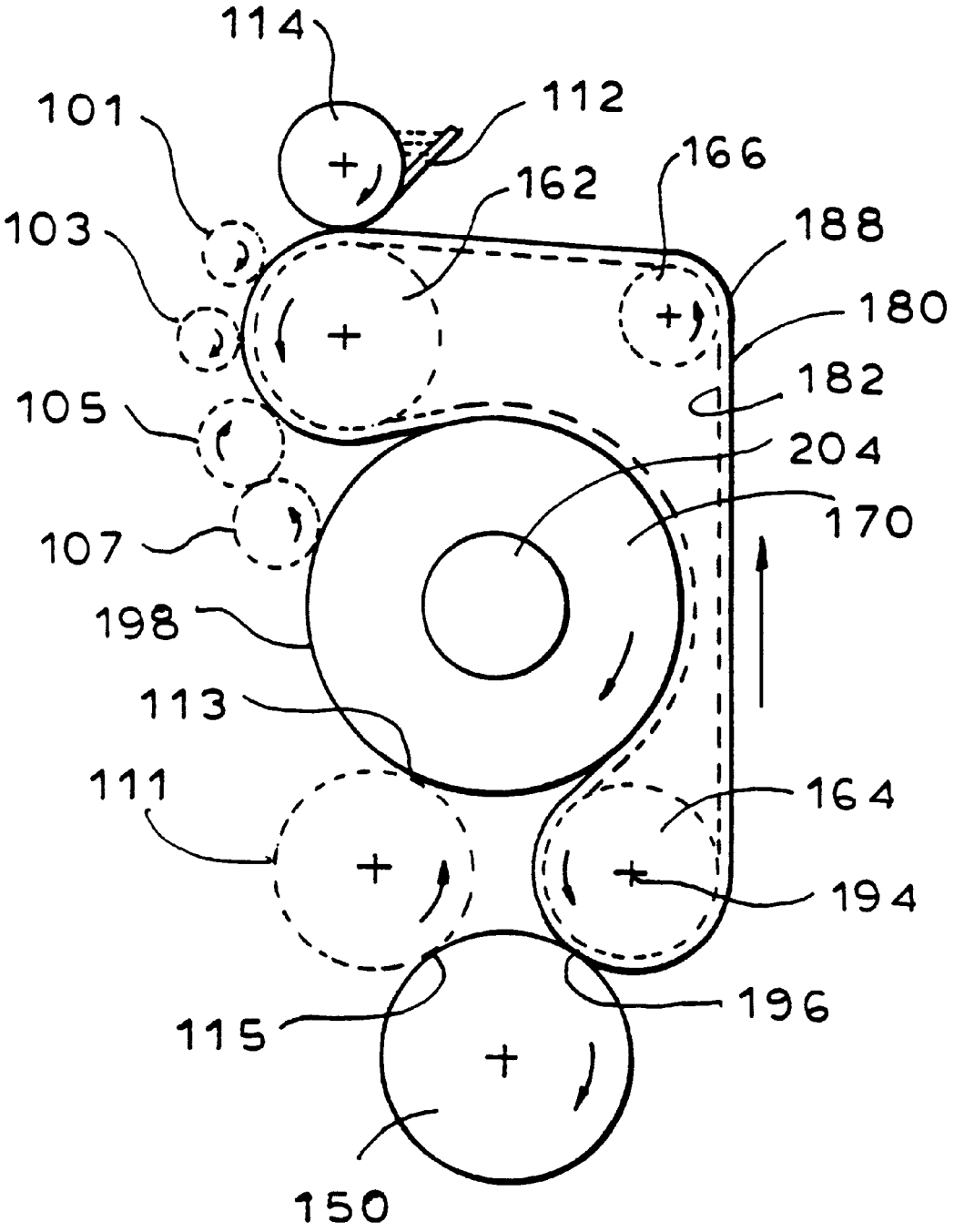
FIG. 7 is a schematic side view of a second embodiment of an inking system according to the invention.

Elements in FIG. 7 that perform the same function and are in the same general location as in the first embodiment FIG. 5 are identified by the same reference numbers raised by 100 and are not further described.

In the embodiment of FIG. 7, the guide rollers 162, 164, 166 are at different locations, as compared to the guide rollers in FIG. 5. This changes the orientation of the path of the belt 180, without affecting the operation. The guide and drive rollers are inside the belt loop while the ink distribution roller 170 is outside the loop, as before.

This embodiment enables providing so called rider rolls 101, 103, which ride on the ink carrying surface 188 of the belt 180 as it passes around the roller 162, enables providing scavenger rolls 105, 107, which respectively ride on the ink carrying surface 188 of the belt 180 and on the peripheral surface 198 of the roll 170 to scavenge excess ink from those surfaces.

A form roller 111 forms nips, at 113 with the ink distribution roller and 115 and with the printing plate cylinder, helping further to distribute the ink on the printing plate cylinder. The essential features of the invention as described in connection with FIG. 5 are retained in this embodiment.

Figure 8:
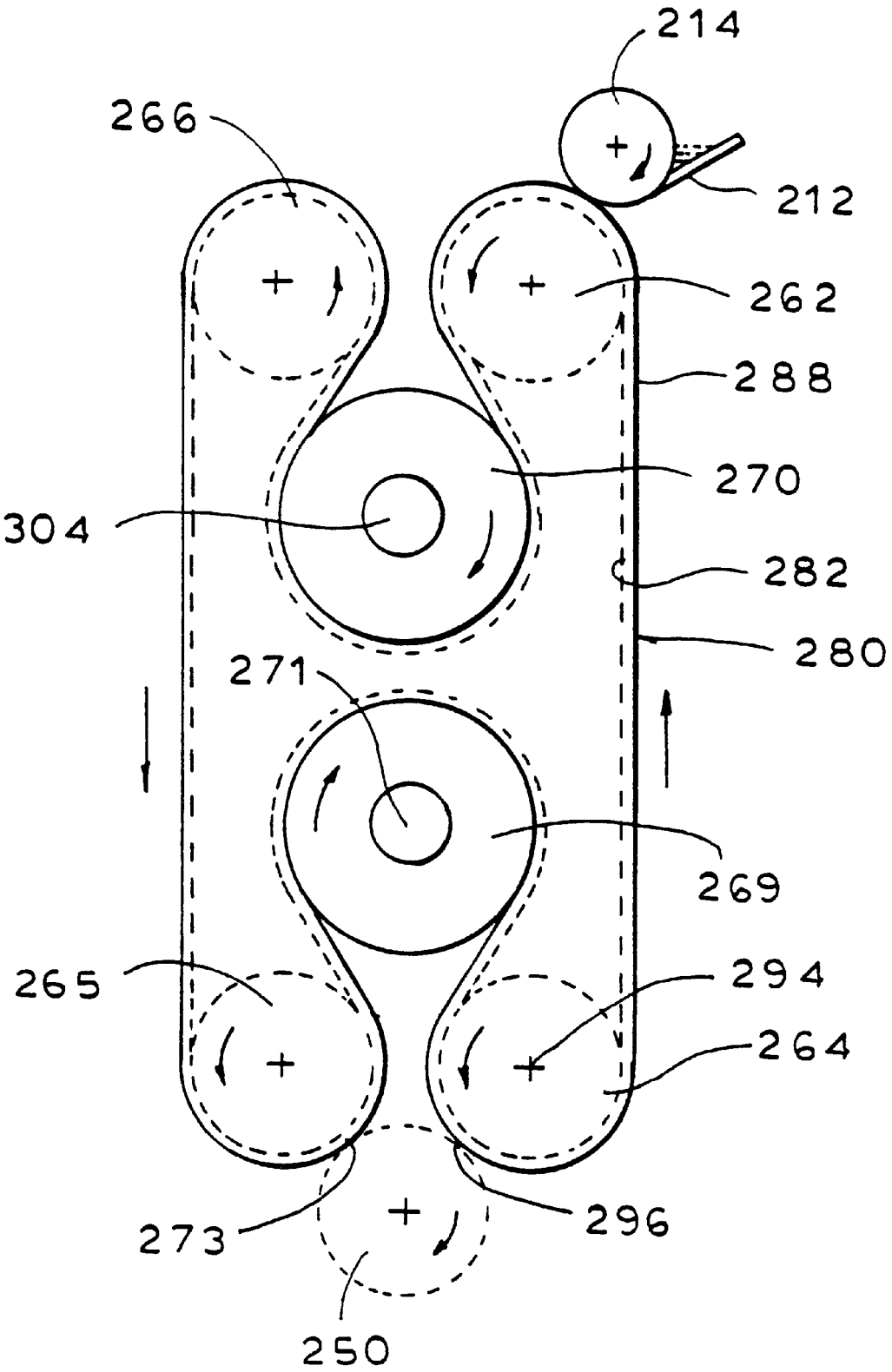
FIG. 8 is a schematic side view of a third embodiment thereof.

The embodiment of FIG. 8 provides yet another configuration of rollers. Elements which are the same in function and general location as in the embodiment of FIG. 5 have reference numbers raised by 200 and are not otherwise described. This embodiment provides the guide rollers, 262, 264 and 266, as above, and an additional guide roller or form roller 265 which functions like the guide or form roller 264 in that it brings the ink carrying surface 288 of the belt 280 into contact a second time with the printing surface or types 246 upraised on the printing plate cylinder 250. Two nips between the belt 280, 288 and the types 246 ensures a greater ink application. On occasion, one nip contact is adequate. For this reason, one or both of the rollers 264 and 265 is on a respective swing arm which is pivotally connected to the machine frame so that the operator can elect to rely only on one application of ink. This is depicted in FIG. 9, for example.

Each time types 246 contact the belt surface, ink is removed and there is a danger of ghost or halo images being printed. To avoid that, an additional ink distribution roller 269 is provided outside the loop of the belt 280 to rub against the outer surface 288 of the belt on the path between the guide rollers 265 and 264, and to distribute ink in addition to the ink distribution function performed by the roll 270. The roll 269 may also be driven by the drive motor 271 and again at a different speed, either faster or slower, than the belt 280, and may be vibrated axially to oscillate with respect to the passing belt surface. The additional guide and drive roller 265 is positioned to provide a second nip or contact of the ink carrying surface 288 of the belt 280 with the printing surface and the additional ink distribution roller 269 provides ink distribution and eliminates irregularities in the ink on the surface 288 between the first contact at the nip 273 and the second contact at the nip 296, whereby the printing plate cylinder 250 is inked twice during each revolution.

For the embodiment of FIG. 9 elements that have the same function and are generally in the same locations as in FIG. 5 are correspondingly numbered with reference numbers raised by 300 and are not further described.

The embodiment of FIG. 9 provides a single ink distribution roller 375 which is driven to rotate and vibrate by the motor and drive 377, as in the other embodiments. There is a first belt 380 which partially wraps the oncoming side 379 of the roller 375 on its pass from the roller 362 to the guide roller 364. The first belt 380 is supported only by two guide rollers 362, 364, not by three rollers, and by the ink distribution roller 375. The belt 380 caries ink from the ink supply 312 to the printing plate cylinder through passing over the arcuate portion 379 of the ink distribution roller 375, where the ink is distributed.

There is also a second endless loop belt 400 which is of the same type as the first belt 380, and which has a drive surface 402 and an opposite ink carrying surface 404. The belt 400 rides over the guide and drive rollers 365, 366 and is the initial contact at nip 373 with the printing plate cylinder 350.

In order that the belt 400 move as desired, the roller 365 is driven by the drive 381, at a speed coordinated with that of the drive motor 394 for the drive roller 364, so that both belts 400 and 380 move at the identical speed and their rollers move at the identical, peripheral speed, which is necessary since there should be no slippage at the nip 373 with the belt 400 and the nip 396 with the belt 380.

The single ink distribution roller 375 has a residual ink region 391 between the separation of the belt 380 on the down run toward the roller 364 and the contact of the roll 375 with the up running belt 400 where residual ink remains on the roller surface after it is transferred onto that surface from the surface 388 of the belt 380. That ink, in turn, partially transfers to the ink carrying surface 404 of the second ink carrying belt 400 to be carried to the nip 373 where it transfers to the surface of the printing plate cylinder 350. The roller 375 also has a redistributed residual ink region 393 on which some of the ink that has transferred to the surface of the roller 375 off the belt 380 remains as that roller surface revolves back to the belt 383. That redistributed residual ink region is between the separation of the ink distribution roller 375 from the belt 400 and the initial contact of the redistributed residual ink region with the belt 400. As discussed above for FIG. 8, at least one guide roll 365 is on a swing arm 367, which enables an operator to move the guide roll 365 and the belt 380 off the print cylinder 350, so that the types are inked once, not twice. This arm can be used in any embodiment.

Other variations and embodiments should be apparent to one of skill in the art.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An inking system comprising:

an ink transfer roller having a first axis about which the ink transfer roller is rotatable, the ink transfer roller having a periphery for receiving ink from an ink supply;

an ink transfer belt having an ink transfer surface and an opposite drive surface, the ink transfer surface being in contact with the ink transfer roller at a first nip for transferring ink from the ink transfer roller onto the ink transfer surface;

a first belt guide roller having a periphery located for engaging the drive surface of the ink transfer belt and for urging the ink transfer surface of the ink transfer belt against the ink transfer roller to define the first nip;

a second belt guide roller having a periphery located for engaging the drive surface of the ink transfer belt for urging the ink transfer surface of the ink transfer belt against a printing plate for defining a second nip and for transferring ink from the ink transfer surface of the ink transfer belt to ink receiving elements on the printing plate;

the first and the second guide rollers having respective axes and being rotatable about their respective axes;

a rotation drive connected with at least one of the guide rollers for driving the one guide roller connected to the drive to rotate the periphery thereof at a first speed, and the periphery of the one guide roller being in contact with the drive surface of the ink transfer belt for driving the belt to move at the peripheral speed of the one guide roller;

an ink distribution roller having a peripheral ink distribution surface in contact with the ink transfer surface of the ink transfer belt at a location between the first and second nips on the portion of the surface of the ink transfer belt carrying ink, the ink distribution surface being adapted to rub the ink on the ink transfer surface of the belt as the ink transfer surface of the belt moves past the ink distribution roller;

the ink distribution roller having a rotation axis about which the ink distribution roller is rotated and having a periphery which rotates in engagement with the ink transfer surface of the ink transfer belt;

a drive to the ink distribution roller for rotating the ink distribution roller so that the ink distribution surface rotates at a speed different than the speed of the ink transfer surface of the belt as the belt moves past the ink distribution roller for aiding in the distribution of the ink on the ink transfer surface of the belt;

wherein the ink transfer belt is an endless loop belt having an exterior surface which is the ink transfer surface and having an interior surface, which is the drive surface of the belt;

further comprising a third guide roller spaced from the first and second guide rollers, located inside the loop of the ink transfer belt, in engagement with the drive surface of the ink transfer belt and having a rotation axis about which the third guide roller is rotatable;

the third guide roller having a respective periphery also in driving engagement with the drive surface of the ink transfer belt, so that the ink transfer belt and the peripheral surfaces of the first, second and third guide rollers move at the same velocity and in the same direction; and further comprising a second one of the ink distribution rollers spaced from the first mentioned one of the ink distribution rollers, and the second ink distribution roller having a respective second axis about which the second ink distribution roller rotates and having a respective second peripheral surface in engagement with the ink transfer surface of the ink transfer belt.

2. The inking system of claim 1, further comprising a second drive to the second ink distribution roller to rotate the second ink distribution roller at a speed different that the speed of the ink transfer surface of the belt as the belt moves past the second ink distribution roller.

3. The inking system of claim 1, wherein at least two of the guide rollers are positioned in the loop of the ink transfer belt at locations selected to bring the inking surface of the ink transfer belt into ink transfer contact with the ink receiving elements on the printing plate at two circumferentially spaced apart locations around the printing plate, the second ink distribution roller being located on the path of the ink transfer belt between the at least two of the guide rollers and between one of the nips at the ink transfer surface caused by one of the two guide rollers and the other of the nips at the ink transfer surface caused by the other of the two guide rollers.

4. An inking system comprising:

an ink transfer roller having a first axis about which the ink transfer roller is rotatable, the ink transfer roller having a periphery for receiving ink from an ink supply;

an ink transfer belt having an ink transfer surface and an opposite drive surface, the ink transfer surface contacts the ink transfer roller at a first nip for transferring ink from the ink transfer roller onto the ink transfer surface;

a first belt guide roller having a periphery located for engaging the drive surface of the ink transfer belt and for urging the ink transfer surface of the ink transfer belt against the ink transfer roller to define the first nip;

a second belt guide roller having a periphery located for engaging the drive surface of the ink transfer belt for urging the ink transfer surface of the ink transfer belt against a printing plate for defining a second nip and for transferring ink from ink transfer surface of the ink transfer belt to ink receiving elements on the printing plate;

the first and the second belt guide rollers having respective axes and being rotatable about their respective axes; a rotation drive connected with at least one of the guide rollers for driving the one guide roller connected to the drive to rotate the periphery thereof at a first speed, and the periphery of the one guide roller being in contact with the drive surface of the ink transfer belt for driving the belt to move at the peripheral speed of the one guide roller and for driving the other drive rollers at the same peripheral speed as the drive surface of the belt moving past the guide rollers;

an ink distribution roller having a peripheral ink distribution surface in contact with the ink transfer surface of the ink transfer belt at a location between the first and second nips on the portion of the surface of the ink transfer belt carrying ink, the ink distribution surface being adapted to rub the ink on the ink transfer surface of the belt as the ink transfer surface of the belt moves past the ink distribution roller; the ink distribution roller having a rotation axis about which the ink distribution roller is rotated and having a periphery which rotates in engagement with the ink transfer surface of the ink transfer belt; and a drive to the ink distribution roller for rotating the ink distribution roller so that the ink distribution surface rotates at a speed different than the speed of the ink transfer surface of the belt as the belt moves past the ink distribution roller, the drive for the ink distribution roller being operable to also cause the vibration and oscillation of the ink distribution roller along the axial direction of the ink distribution roller as the ink distribution roller is rotated.

5. The inking system of claim 4, wherein the drive for the ink distribution roller drives the ink distribution roller so that the peripheral surface thereof moves slower than the speed of the ink transfer surface of the ink transfer belt past the ink distribution roller.

6. The inking system of claim 4, wherein the drive for the ink distribution roller drives the ink distribution roller so that the peripheral surface thereof moves faster than the speed of the ink transfer surface of the ink transfer roll past the ink distribution roller.

7. The inking system of claim 4, wherein the guide rollers and the ink distribution roller are so placed that the ink transfer belt partially wraps the peripheral surface of the ink distribution roller.

8. The inking system of claim 4, wherein there is a drive profile on the periphery of at least one of the guide rollers, the drive surface of the ink transfer belt having a cooperating profile complementary to the drive profile on the periphery of the one guide roller, and the drive and complementary profiles being shaped for positive drive of the ink transfer belt as the guide rollers rotate, while blocking lateral movement in the axial direction of the belt upon vibration oscillation of the ink distribution roller.

9. The inking system of claim 4, wherein the ink transfer belt is an endless loop belt having an exterior surface which is the ink transfer surface and having an interior surface, which is the drive surface of the belt.

10. The inking system of claim 9, further comprising a third guide roller spaced from the first and second guide rollers, located inside the loop of the ink transfer belt, in engagement with the drive surface of the ink transfer belt and having a rotation axis about which the third guide roller is rotatable; the third guide roller having a respective periphery also in driving engagement with the drive surface of the ink transfer belt, so that the ink transfer belt and the peripheral surfaces of the first, second and third guide rollers move at the same velocity and in the same direction.

11. The inking system of claim 10, wherein the axis of the third guide roller is movable for adjusting the tension on the ink transfer belt and for guiding the ink transfer belt.

12. The inking system of claim 4, further comprising:

a second ink transfer belt having a second ink transfer surface and having an opposite second drive surface;

third and fourth respective guide rollers in driving contact with the second drive surface of the second belt;

a drive to at least one of the third and fourth guide rollers for driving the second guide belt to move past the third and fourth guide rollers;

the third and fourth guide rollers being so positioned as to bring the second ink transfer surface of the second belt into contact with the ink distribution roller at a circumferential region around the ink distribution roll that is spaced away from the circumferential region of the ink distribution roller which is contacted by the first mentioned ink transfer surface of the first mentioned ink transfer belt.

13. The inking system of claim 12, wherein each of the first mentioned belt and the second belt is a respective endless loop belt.

14. The inking system of claim 13, wherein the fourth guide roll supports the second belt so that the second ink transfer surface of the second belt forms a nip with the ink receiving elements on the printing plate.

15. The inking system of claim 4, further comprising an ink supply at the ink transfer roll for containing a supply of ink to be transferred to the periphery of the ink transfer roll.

16. The inking system of claim 4, wherein there is a drive profile on the periphery of at least one of the guide rollers, the drive surface of the ink transfer belt having a cooperating profile complementary to the drive profile on the periphery of the one guide roller, and the drive and complementary profiles being shaped for positive drive of the ink transfer belt as the guide rollers rotate, while blocking lateral movement in the axial direction of the belt upon vibration oscillation of the ink distribution roller.

17. A method for supplying ink to the printing plate cylinder of an inking system, wherein the inking system comprises:

an endless loop ink transfer belt having an outer ink transfer surface and an opposite inner drive surface and the printing plate cylinder has ink receiving elements on the surface thereof for receiving ink from the ink transfer surface of the belt, the method comprising:

rotating the ink transfer belt at a first speed;

supplying ink to the ink transfer surface of the ink transfer belt at a location along the path of the belt spaced from the ink receiving elements;

rotating the belt with ink on the ink transfer surface thereof from the location where ink is supplied thereto to the ink receiving elements on the printing plate cylinder and forming a nip at the printing plate cylinder so that ink is transferred from the ink transfer surface of the belt to the ink receiving elements on the printing plate cylinder;

partially wrapping the ink transfer surface of the belt around the peripheral surface of an ink distribution roller disposed along the path of the belt between the location of ink supply and the nip with the ink transfer elements;

driving the ink distribution roller to rotate with respect to the ink transfer surface of the belt at a speed different than the speed of the belt for aiding distribution of the ink on the ink transfer surface of the belt; and simultaneously driving the ink distribution roller to vibrate axially as it rotates, the angle of wrap of the ink transfer surface around the ink distribution roller being large enough that the ink transfer surface experiences several oscillations as the ink distribution roller rubs over the ink transfer surface of the belt.

18. The ink method of claim 17, wherein the ink distribution roller is driven to rotate in the same direction as and at a slower speed than the direction and speed of the belt past the ink distribution roller.

19. The ink method of claim 17, wherein the ink distribution roller is driven to rotate in the same direction as and at a faster speed than the direction and speed of the belt past the ink distribution roller.

20. A method of claim 17, wherein the ink distribution roller is rotated at a speed that is in the range of 2% to 40% different than the speed of the belt.

21. An inking system comprising:

an ink transfer roller having a first axis about which the ink transfer roller is rotatable, the ink transfer roller having a periphery for receiving ink from an ink supply;

an ink transfer belt having an ink transfer surface and an opposite drive surface, the ink transfer surface being in contact with the ink transfer roller at a first nip for transferring ink from the ink transfer roller onto the ink transfer surface;

a first belt guide roller having a periphery located for engaging the drive surface of the ink transfer belt and for urging the ink transfer surface of the ink transfer belt against the ink transfer roller to define the first nip;

a second belt guide roller having a periphery located for engaging the drive surface of the ink transfer belt for urging the ink transfer surface of the ink transfer belt against a printing plate for defining a second nip and for transferring ink from the ink transfer surface of the ink transfer belt to ink receiving elements on the printing plate;

the first and the second guide rollers having respective axes and being rotatable about their respective axes;

a rotation drive connected with at least one of the guide rollers for driving the one guide roller connected to the drive to rotate the periphery thereof at a first speed, and the periphery of the one guide roller being in contact with the drive surface of the ink transfer belt for driving the belt to move at the peripheral speed of the one guide roller;

an ink distribution roller having a peripheral ink distribution surface in contact with the ink transfer surface of the ink transfer belt at a location between the first and second nips on the portion of the surface of the ink transfer belt carrying ink, the ink distribution surface being adapted to rub the ink on the ink transfer surface of the belt as the ink transfer surface of the belt moves past the ink distribution roller; the ink distribution roller having a rotation axis about which the ink distribution roller is rotated and having a periphery which rotates in engagement with the ink transfer surface of the ink transfer belt; and a drive to the ink distribution roller for rotating the ink distribution roller so that the ink distribution surface rotates at a speed different than the speed of the ink transfer surface of the belt as the belt moves past the ink distribution roller for aiding in the distribution of the ink on the ink transfer surface of the belt, the periphery of at least one of the guide rollers having a drive profile thereon which cooperates with a complementary profile on the drive surface of the ink transfer belt, the drive and complementary profiles being shaped for positive drive of the ink transfer belt longitudinally as the guide rollers rotate, wherein slippage between the ink transfer belt and the printing plate is prevented.

22. The inking system of claim 21, wherein the drive for the ink distribution roller drives the ink distribution roller so that the peripheral surface thereof moves slower than the speed of the ink transfer surface of the ink transfer belt past the ink distribution roller.

23. The inking system of claim 21, wherein the drive for the ink distribution roller drives the ink distribution roller so that the peripheral surface thereof moves faster than the speed of the ink transfer surface of the ink transfer roll past the ink distribution roller.

24. The inking system of claim 21, wherein the guide rollers and the ink distribution roller are so placed that the ink transfer belt partially wraps the peripheral surface of the ink distribution roller.

25. The inking system of claim 21, wherein the ink transfer belt is an endless loop belt having an exterior surface which is the ink transfer surface and having an interior surface, which is the drive surface of the belt.

26. The inking system of claim 25, further comprising:

a third guide roller spaced from the first and second guide rollers, located inside the loop of the ink transfer belt, in engagement with the drive surface of the ink transfer belt and having a rotation axis about which the third guide roller is rotatable;

third guide roller having a respective periphery also in driving engagement with the drive surface of the ink transfer belt, so that the ink transfer belt and the peripheral surfaces of the first, second and third guide rollers move at the same velocity and in the same direction.

27. The inking system of claim 26, wherein the axis of the third guide roller is movable for adjusting the tension on the ink transfer belt and for guiding the ink transfer belt.

28. The inking system of claim 21, further comprising a second ink transfer belt having a second ink transfer surface and having an opposite second drive surface;

third and fourth respective guide rollers in driving contact with the second drive surface of the second belt;

a drive to at least one of the third and fourth guide rollers for driving the second guide belt to move past the third and fourth guide rollers;

the third and fourth guide rollers being so positioned as to bring the second ink transfer surface of the second belt into contact with the ink distribution roller at a circumferential region around the ink distribution roll that is spaced away from the circumferential region of the ink distribution roller which is contacted by the first mentioned ink transfer surface of the first mentioned ink transfer belt.

29. The inking system of claim 28, wherein each of the first mentioned belt and the second belt is a respective endless loop belt.

30. The inking system of claim 29, wherein the fourth guide roll supports the second belt so that the second ink transfer surface of the second belt forms a nip with the ink receiving elements on the printing plate.

31. The inking system of claim 21, further comprising an ink supply at the ink transfer roll for containing a supply of ink to be transferred to the periphery of the ink transfer roll.

32. The inking system of claim 21, wherein the drive profile on the one drive roller and the complementary profile on the drive surface of the ink transfer belt respectively comprise projections which engage with each other as the drive roller rotates on the drive surface of the inking belt.

33. The inking system of claim 21, wherein the drive profile runs in a generally axial direction on the one drive roller and the complementary profile runs in a generally transverse direction on the drive surface of the ink transfer belt.

34. A method for supplying ink to the printing plate cylinder of an inking system, wherein the inking system comprises:

an endless loop ink transfer belt having an outer ink transfer surface and an opposite inner drive surface and the printing plate cylinder has ink receiving elements on the surface thereof for receiving ink from the ink transfer surface of the belt, the method comprising:

engaging a drive profile on the peripheral surface of a drive roller with a complementary profile on the drive surface of the ink transfer belt to rotate the ink transfer belt at a first speed;

supplying ink to the ink transfer surface of the ink transfer belt at a location along the path of the belt spaced from the ink receiving elements;

rotating the belt with ink on the ink transfer surface thereof from the location where ink is supplied thereto to the ink receiving elements on the printing plate cylinder and forming a nip at the printing plate cylinder so that ink is transferred from the ink transfer surface of the belt to the ink receiving elements on the printing plate cylinder;

partially wrapping the ink transfer surface of the belt around the peripheral surface of an ink distribution roller disposed along the path of the belt between the location of ink supply and the nip with the ink transfer elements; and driving the ink distribution roller to rotate with respect to the ink transfer surface of the belt at a speed different than the speed of the belt for aiding distribution of the ink on the ink transfer surface of the belt, the drive and complementary profiles being shaped for positive drive of the ink transfer belt as the drive roller rotates, thereby preventing slippage between the belt and the printing plate.

35. The inking method of claim 34, wherein the ink distribution roller is driven to rotate in the same direction as and at a slower speed than the direction and speed of the belt past the ink distribution roller.

36. The inking method of claim 34, wherein the ink distribution roller is driven to rotate in the same direction as and at a faster speed than the direction and speed of the belt past the ink distribution roller.

37. The inking method of claim 34, wherein the ink distribution roller is rotated at a speed that is in the range of 2% to 40% different than the speed of the belt.

38. The inking method of claim 34, wherein the drive profile on the one drive roller and the complementary profile on the drive surface of the ink transfer belt respectively comprise projections which engage with each other as the drive roller rotates on the drive surface of the inking belt.

39. The inking method of claim 34, wherein the drive profile runs in a generally axial direction on the one drive roller and the complementary profile runs in a generally transverse direction on the drive surface of the ink transfer belt.

40. An inking system comprising:

an ink transfer roller which receives ink from an ink supply;

an ink transfer belt having an ink transfer surface in contact with the ink transfer roller at a first nip to receive ink from the ink transfer roller;

a first guide roller that engages the ink transfer belt and cooperates with the ink transfer roller to define the first nip;

a second guide roller that engages the ink transfer belt and cooperates with a printing plate to define a second nip at which ink is transferred from the ink transfer belt to ink receiving elements on the printing plate;

a first drive that rotates at least one of the guide rollers at a first peripheral speed, the engagement of the one guide roller with the ink transfer belt causing the belt to move at the peripheral speed of the one guide roller;

an ink distribution roller that engages with the ink transfer surface of the ink transfer belt at a location between the first and second nips, the ink distribution surface being adapted to rub the ink on the ink transfer surface of the belt as the ink transfer surface of the belt moves past the ink distribution roller; and a second drive that rotates the ink distribution roller at a peripheral speed different than the speed of the ink transfer belt to aid in the distribution of the ink on the ink transfer surface of the belt.

41. The inking system of claim 40, wherein the second drive moves the ink distribution roller at a peripheral speed which is slower than the speed of the ink transfer surface of the ink transfer belt past the ink distribution roller.

42. The inking system of claim 40, wherein the second drive moves the ink distribution roller at a peripheral speed which is faster than the speed of the ink transfer surface of the ink transfer belt past the ink distribution roller.

43. The inking system of claim 40, wherein the guide rollers and the ink distribution roller are so placed that the ink transfer belt is partially wrapped around the ink distribution roller.

44. The inking system of claim 40, wherein the second drive is operable to also cause axial vibration and oscillation of the ink distribution roller.

45. The inking system of claim 44, further including:

a drive profile on at least one of the guide rollers; and a complementary profile on the ink transfer belt which cooperates with the drive profile on the periphery of the one guide roller, the drive and complementary profiles being shaped for positive drive of the ink transfer belt as the one guide rollers rotates, while blocking lateral movement of the belt along the axis of the guide roller upon vibration and oscillation of the ink distribution roller.

46. The inking system of claim 40, wherein the ink transfer belt is an endless loop belt having an exterior surface which is the ink transfer surface and having an interior surface, which is a drive surface.

47. The inking system of claim 45, further comprising:

a third guide roller spaced from the first and second guide rollers, located inside the loop of the ink transfer belt, in engagement with the drive surface of the ink transfer belt; and wherein:

the ink transfer belt and the first, second and third guide rollers move at the same velocity and in the same direction.

48. The inking system of claim 47, wherein the axis of the third guide roller is movable for adjusting the tension on the ink transfer belt and for guiding the ink transfer belt.

49. The inking system of claim 47, further comprising:

a second ink distribution roller spaced from the first mentioned one of the ink distribution roller, the second ink distribution roller having a second peripheral surface in engagement with the ink transfer surface of the ink transfer belt.

50. The inking system of claim 49, further comprising a second drive to the second ink distribution roller to rotate the second ink distribution roller at a peripheral speed different from the speed of the ink transfer surface of the belt as the belt moves past the second ink distribution roller.

51. The inking system of claim 49, wherein:

at least two of the guide rollers are positioned in the loop of the ink transfer belt at locations selected to bring the inking surface of the ink transfer belt into ink transfer contact with the ink receiving elements on the printing plate at two circumferentially spaced apart locations around the printing plate, the second ink distribution roller being located on the path of the ink transfer belt between the at least two of the guide rollers and between one of the nips at the ink transfer surface caused by one of the two guide rollers and the other of the nips at the ink transfer surface caused by the other of the two guide rollers.

52. The inking system of claim 40, further comprising:

a second ink transfer belt having a second ink transfer surface;

third and fourth respective guide rollers in driving contact with the second belt;

a drive to at least one of the third and fourth guide rollers for driving the second belt, the third and fourth guide rollers being so positioned as to bring the ink transfer surface of the second belt into contact with the ink distribution roller at a circumferential region of the ink distribution roll that is spaced away from the circumferential region which is contacted by the ink transfer surface of the first mentioned ink transfer belt.

53. The inking system of claim 52, wherein each of the first and second belts is a respective endless loop belt.

54. The inking system of claim 53, wherein the fourth guide roll supports the second belt so that the ink transfer surface thereof forms a nip with the ink receiving elements on the printing plate.

55. The inking system of claim 40, further comprising an ink supply coupled to the ink transfer roll for transferring ink thereto.

56. The inking system of claim 40, further comprising:

a drive profile on at least one of the guide rollers; and a complementary profile on the ink transfer belt cooperating with the drive profile, the drive profile and the complementary profile on the ink transfer belt being shaped for positive drive of the ink transfer belt as the guide rollers rotate, while blocking movement of the belt in the axial direction of the guide rollers.

57. The inking system of claim 56, wherein the profiles are respectively comprised of projections which engage with each other as the one drive roller rotates the inking belt.

58. The inking system of claim 56, wherein the drive profile runs in a generally axial direction on the one drive roller and the complementary profile runs in a generally lateral direction on the ink transfer belt.

* * * * *